US008196314B2

(12) United States Patent
Munch

(10) Patent No.: US 8,196,314 B2
(45) Date of Patent: Jun. 12, 2012

(54) APPARATUS FOR DRYING A FIBROUS WEB

(75) Inventor: Christian Munch, Sao Paulo S.P. (BR)

(73) Assignee: Voith Patent GmbH, Heidenheim ( * ) Notice: Subject to any disclaimer, the term of this patent is extended or adjusted under 35 U.S.C. 154(b) by 1127 days.

(21) Appl. No.: 12/027,619

(22) Filed: Feb. 7, 2008

(65) Prior Publication Data

US 2008/0189981 A1 Aug. 14, 2008

(30) Foreign Application Priority Data

Feb. 13, 2007 (DE) ..... 10 2007 006 960

(51) Int. Cl.
*F26B 13/10* (2006.01)

(52) U.S. Cl. ..... 34/618; 34/114; 34/124; 162/115; 162/205

(58) Field of Classification Search ..... 34/618, 34/114, 117, 124, 125, 210, 242; 162/115, 162/205
See application file for complete search history.

(56) References Cited

U.S. PATENT DOCUMENTS 3,432,936 A * 3/1969 Greenhalgh et al. ..... 34/306
3,447,247 A 6/1969 Daane
4,103,434 A * 8/1978 Walker ..... 34/114
4,326,342 A * 4/1982 Schregenberger ..... 34/538
4,328,626 A * 5/1982 Leitner ..... 34/115
4,481,722 A 11/1984 Guy et al.
4,615,122 A 10/1986 Sherrod et al.
5,306,395 A * 4/1994 Myren ..... 162/301
5,974,691 A 11/1999 Marchal et al.
6,138,380 A * 10/2000 Veijola et al. ..... 34/446
6,199,296 B1 * 3/2001 Jewitt ..... 34/115
6,904,700 B2 * 6/2005 Hada et al. ..... 34/117
2002/0148584 A1 * 10/2002 Edwards et al. ..... 162/204
2004/0128858 A1 7/2004 Sundqvist et al.
2005/0132598 A1 6/2005 Reddy
2005/0167061 A1 8/2005 Scherb et al.
2008/0189981 A1 * 8/2008 Munch ..... 34/618
2009/0165979 A1 * 7/2009 Scherb et al. ..... 162/210
2009/0165980 A1 * 7/2009 Scherb et al. ..... 162/210

FOREIGN PATENT DOCUMENTS

CA 2262397 A1 8/1999
WO WO0100925 A 1/2001

* cited by examiner

*Primary Examiner* — Stephen M. Gravini
(74) *Attorney, Agent, or Firm* — Taylor IP, P.C.

(57) ABSTRACT

Disclosed is an apparatus for drying a fibrous web, in particular a paper web, paperboard web or tissue web, by way of hot air, on which the fibrous web is charged with the supply air for the drying from a supply air chamber and on which exhaust air from the drying operation passes into an exhaust air chamber, whereby the exhaust air from the exhaust air chamber is supplied at least partly to the suction side of a pressure booster and at least a part of the supply air from the pressure side of the pressure booster is supplied to the supply air chamber.

46 Claims, 2 Drawing Sheets

APPARATUS FOR DRYING A FIBROUS WEB

BACKGROUND OF THE INVENTION

1. Field of the Invention

This invention relates to an apparatus for drying a fibrous web, in particular a paper web, paperboard web or tissue web, by way of hot air. The invention relates in addition to a machine for producing a fibrous web with a three-dimensional surface structure, said machine having such a drying apparatus.

2. Description of the Related Art

On the known apparatuses of said type, the respective hot air drying process involves a relatively high energy outlay.

What is needed in the art is an improved apparatus and an improved machine of the type initially referred to. More specifically, what is needed is the apparatus and machine being optimized in particular inasmuch as the energy outlay required for the hot air drying process is reduced to a minimum.

SUMMARY OF THE INVENTION

The present invention provides an apparatus for drying a fibrous web, in particular a paper web, paperboard web or tissue web, by way of hot air, on which the fibrous web is charged with the supply air for the drying from a supply air chamber and on which exhaust air from the drying operation passes into an exhaust air chamber, whereby the exhaust air from the exhaust air chamber is supplied at least partly to the suction side of a pressure booster and at least a part of the supply air from the pressure side of the pressure booster is supplied to the supply air chamber.

The result, by virtue of this construction, is a hot air circuit on which the exhaust air from the drying operation is used, by which way energy is saved accordingly.

On a practical embodiment, the drying apparatus includes a so-called impingement drying device.

In this case the supply air chamber and the exhaust air chamber are arranged on the same side of the fibrous web.

The supply air chamber and the exhaust air chamber can form a shared space.

According to an advantageous alternative embodiment, the drying apparatus includes a through-flow drying device.

In this case the supply air chamber and the exhaust air chamber can lie on opposite sides of the fibrous web.

In this case it is an advantage for a positive pressure in the range from approximately 0 to approximately 0.5 bar and preferably in a range from approximately 0.002 to approximately 0.3 bar to exist in the supply air chamber.

Preferably a positive pressure $\geqq 0.01$, in particular $\geqq 0.02$ and preferably $\geqq 0.05$ bar exists in the supply air chamber.

In addition it is an advantage for a negative pressure in a range from approximately 0 to approximately 0.8 bar and preferably in a range from approximately 0.2 to approximately 0.7 bar to exist in the exhaust air chamber.

Preferably a negative pressure in a range from approximately 0.4 to approximately 0.7 exists in the exhaust air chamber.

According to a practical embodiment of the inventive drying apparatus, the pressure booster includes at least one blower, which can be for example a multi-stage blower or a single-stage blower. Such a blower of the type in question is marketed under the name "Tubair".

Advantageously it is also possible however for the pressure booster to include at least one radial blower and/or at least one axial blower.

The temperature of the supply air or supply air fraction originating from the pressure booster is preferably $\geqq 100°$ C., in particular $\geqq 150°$ C. and preferably $\geqq 200°$ C.

It is also an advantage in particular for the supply air chamber to be supplied with more than 50%, in particular more than 60%, in particular more than 70% and preferably more than 80% of the supply air from the pressure side of the pressure booster.

According to an expedient practical embodiment of the inventive drying apparatus, at least essentially 100% of the supply air from the pressure side of the pressure booster is supplied to the supply air chamber.

If only a part of the supply air from the pressure side of the pressure booster is supplied to the supply air chamber, then the rest of the supply air can be supplied advantageously from another hot air process of the fibrous web production.

It is an advantage in addition to provide, in particular in a supply air supply line connected to the supply air chamber, a heat exchanger for increasing the supply air temperature.

On a practical embodiment provision is made, in particular in a supply air supply line connected to the supply air chamber, for an in particular adjustable and/or controllable heating device for increasing the supply air temperature.

The heating device can include in particular a gas burner, a gas turbine and/or the like.

It is an advantage in particular also to provide a water separator, in particular a condensation device, in order to remove water from the exhaust air.

According to a practical embodiment of the inventive drying apparatus, the exhaust air chamber is formed by the suction box of a suction roller and the supply air chamber by a hood assigned to said suction roller.

In this case the fibrous web can be passed, in particular together with a permeable structured belt, over the suction roller, whereby the fibrous web lies between the permeable structured belt and the suction roller and the hot supply air flows out from the hood in succession through the permeable structured belt and the fibrous web into the suction box of the suction roller.

The permeable structured belt and the fibrous web can be pressed in this case by way of a permeable press belt against the suction roller, whereby the hot supply air flows out from the hood in succession through the permeable press belt, the permeable structured belt and the fibrous web into the suction box of the suction roller.

In addition, a dewatering belt can be passed around the suction roller such that said dewatering belt lies between the suction roller and the permeable structured belt and the hot air flows through said dewatering belt into the suction box of the suction roller.

According to another advantageous embodiment, the supply air supplied to the supply air chamber can be taken partly from a hood which is assigned to a drying cylinder, in particular a Yankee cylinder, which together with a press element forms a nip through which the fibrous web is passed directly after the suction roller.

In this case the hot air taken from the hood assigned to the drying cylinder can be supplied in particular as supplementary air to a pressure-side socket and/or a suction-side socket of the pressure booster.

It is an advantage in particular also to provide at least one water separator in an exhaust air discharge line connected to the exhaust air chamber, in a suction-side socket of the pressure booster and/or in a pressure-side socket of the pressure booster.

In this case the water separator is provided, looking in the flow direction of the returned exhaust air, preferably upstream from the heating device for increasing the supply air temperature and/or upstream from the point at which the hot air taken from the hood of the drying cylinder is supplied.

The inventive machine for producing a fibrous web with a three-dimensional surface structure, in particular a paper web, paperboard web or tissue web, is characterized in that it is equipped with an inventive drying apparatus, whereby the exhaust air chamber is formed by the suction box of a suction roller and the supply air chamber by a hood assigned to said suction roller and the fibrous web is passed together with a permeable structured belt over the suction roller, and whereby the fibrous web lies between the permeable structured belt and the suction roller and the hot supply air flows out from the hood in succession through the permeable structured belt and the fibrous web into the suction box of the roller.

On a practical embodiment of the inventive machine the permeable structured belt and the fibrous web are pressed by way of a permeable press belt against the suction roller, whereby the hot supply air flows out from the hood in succession through the permeable press belt, the permeable structured belt and the fibrous web into the suction box of the suction roller.

In addition, a dewatering belt can be passed around the suction roller such that said dewatering belt lies between the suction roller and the permeable structured belt and the hot air flows through said dewatering belt into the suction box of the suction roller.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
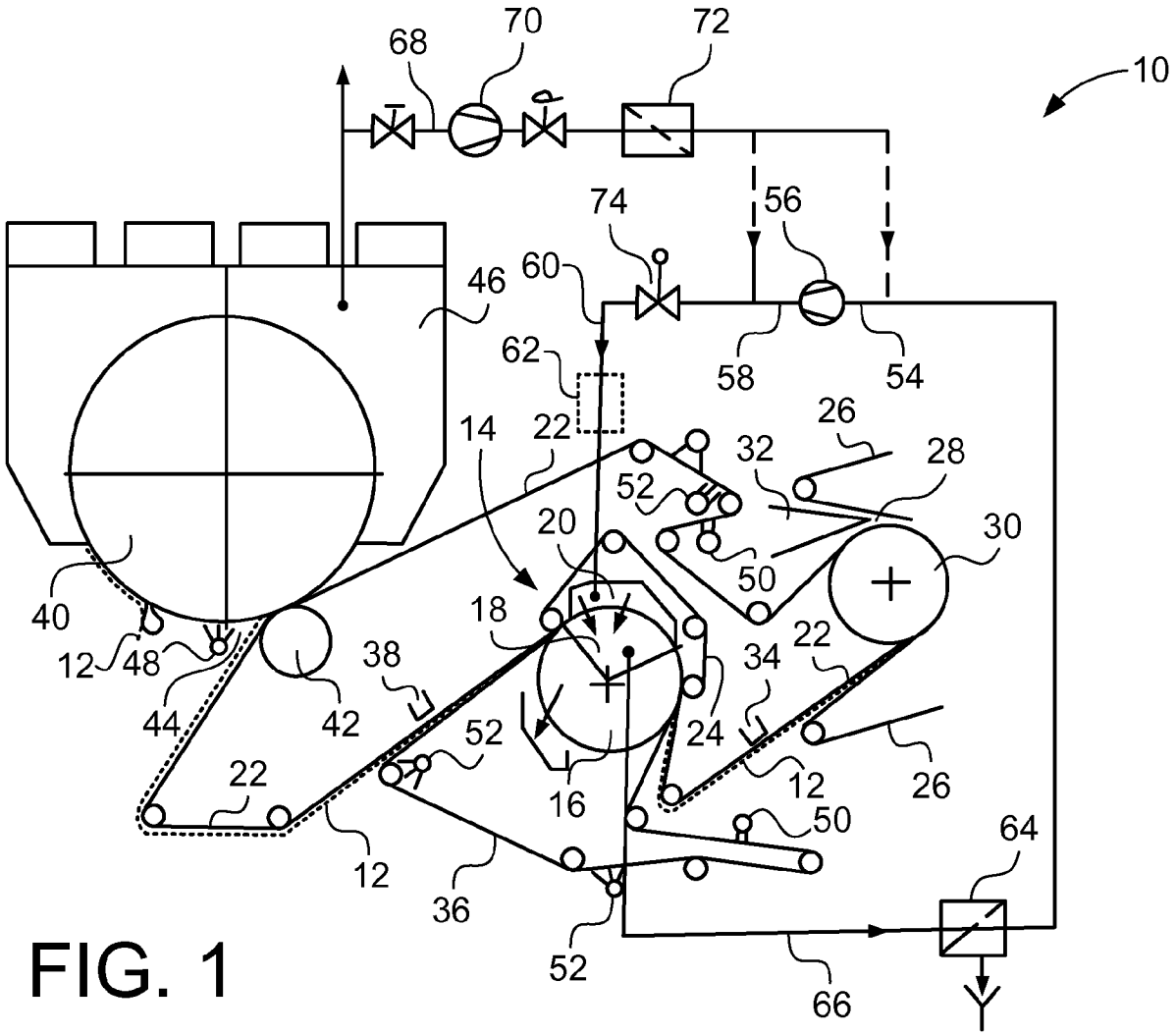
FIG. 1 shows a schematic representation of a machine for producing a fibrous web with a three-dimensional surface structure, said machine having a drying apparatus including a hot air circuit.

Referring now to the drawings, and more particularly to FIG. 1, there is shown a schematic representation a machine 10 for producing a fibrous web 12 with a three-dimensional surface structure, said machine being equipped with an apparatus 14 including a hot air circuit for drying the fibrous web 12. The fibrous web 12 can be in particular a paper web, paperboard web or tissue web.

The drying apparatus 14 includes a suction roller 16 with a suction box 18 forming an exhaust air chamber and a hood 20 assigned to the suction roller 16 and forming a supply air chamber.

In this case the fibrous web 12 is passed together with a permeable structured belt 22 over the suction roller 16, whereby the fibrous web 12 lies between the permeable structured belt 22 and the suction roller 16.

The permeable structured belt 22 and the fibrous web 12 are pressed for example by way of a permeable press belt 24 against the suction roller 16. In this case the hot air flows out from the hood 20 in succession through the permeable press belt 24, the permeable structured belt 22 and the fibrous web 12 into the suction box 18 of the suction roller 16.

In addition, a dewatering belt 36 can be passed around the suction roller 16 such that said dewatering belt 16 lies between the suction roller 16 and the permeable structured belt 22 and the hot supply air flows through said dewatering belt into the suction box 18 of the suction roller 16. Hence in the case in question, the supply air flows in succession through the permeable press belt 24, the permeable structured belt 22, the fibrous web 12 and the dewatering belt 36.

The machine includes in addition a former with two converging dewatering belts 22, 26, whereby the inner belt in the case in question simultaneously forms the permeable structured belt 22. The two dewatering belts 22, 26 converge, thus forming a fiber intake nip 28, and are passed over a forming element 30 such as in particular a forming roller.

In the case in question the permeable structured belt 22 is thus formed by the inner dewatering belt of the former which comes into contact with the forming element 30. The outer dewatering belt 26, which does not come into contact with the forming element 30, is separated again from the fibrous web 12 and from the permeable structured belt 22 carrying said web directly after the forming element 30.

Fibrous suspension is fed by way of a headbox 32 into the fiber intake nip 28. Provided between the forming element 30 and the drying apparatus 14 is a suction element 34 by way of which the fibrous web 12 is held against the permeable structured belt 22 and pressed against said permeable structured belt 22.

Directly after the drying apparatus 14, the dewatering belt 36 is separated again from the permeable structured belt 22 and the fibrous web 12. In this case provision is made behind the drying apparatus 14 for a pickup or separating element 38 by way of which the fibrous web 12 is held against the permeable structured belt 22 during separation from the dewatering belt 36.

Directly afterwards, the fibrous web 12 is passed together with the permeable structured belt 22 through a press nip 44 formed by a drying cylinder 40, such as a Yankee cylinder, and a press element 42 such as a press roller. Behind said press nip 44, the permeable structured belt 22 is separated again from the drying cylinder 40 while the fibrous web 12 remains on the drying cylinder 40. A hood 46 is assigned to the drying cylinder 40.

In addition, a spray tube 48 for coating or the like can be assigned to the drying cylinder 40.

At least one so-called Uhle box 50 and/or at least one spray tube 52 can be assigned to the permeable structured belt 22 and the dewatering belt 36.

The apparatus 14 serves to dry the fibrous web 12 by way of hot air in that the fibrous web 12 is charged with the supply air for the drying from the hood 20 assigned to the suction roller 16. In this case, exhaust air arising during the drying operation passes into the suction box 18 of the suction roller 16. The exhaust air from the suction box 18 is supplied at least partly to the suction side 54 of a pressure booster 56. At least a part of the supply air from the pressure side 58 of the pressure booster 56 is then supplied to the hood 20 assigned to the suction roller 16. A hot air circuit serving to dry the fibrous web 12 is thus formed.

On the embodiment in question there is a type of through-flow drying device on which the supply air chamber formed by the hood 20 and the exhaust air chamber formed by the suction box 18 are arranged on opposite sides of the fibrous web 12.

The pressure booster 56 can include for example at least one blower which can have a single-stage or multi-stage construction.

If only a part of the supply air from the pressure side 58 of the pressure booster 56 or only a part of the air originating from the suction box 18 forming the exhaust air chamber is supplied to the hood 20 assigned to the suction roller 16, then the rest of the supply air can be supplied from another hot air process of the fibrous web production.

Provision can be made, in particular in a supply air supply line 60 connected to the hood 20, for a heat exchanger or an in particular adjustable and/or controllable heating device 62 for increasing the supply air temperature. In the case in question, the heating device 62 includes for example a burner, in particular a gas burner. The use of for example a gas turbine is also possible.

Provision can also be made in particular for a water separator 64, in particular a condensation device, in order to remove water from the exhaust air. On the embodiment in question, such a water separator 64 is arranged in an exhaust air discharge line 66 connected to the suction box 18 of the suction roller 16. In principle it is also possible for such a water separator to be provided in a suction-side socket and/or in a pressure-side socket of the pressure booster 56.

As is evident from FIG. 1, it is possible on the embodiment in question for the supply air supplied to the hood 20 assigned to the suction roller 16 also to be taken partly from the hood 46 assigned to the drying cylinder 40.

In this case the hot air taken from the hood 46 assigned to the drying cylinder 40 can be supplied in particular as supplementary air to a pressure-side socket and/or the suction-side socket of the pressure booster 56. Another pressure booster 70 can be arranged in the respective supply line 68 leading to the socket or sockets of the pressure booster 56. In this supply line 68 it is also possible to provide in particular a filter 72 in addition to servo-valves or control valves.

As is evident from FIG. 1, it is also possible for a control valve 74 to be arranged in the supply air supply line 60 between the pressure booster 56 and the drying apparatus 14.

Figure 2:
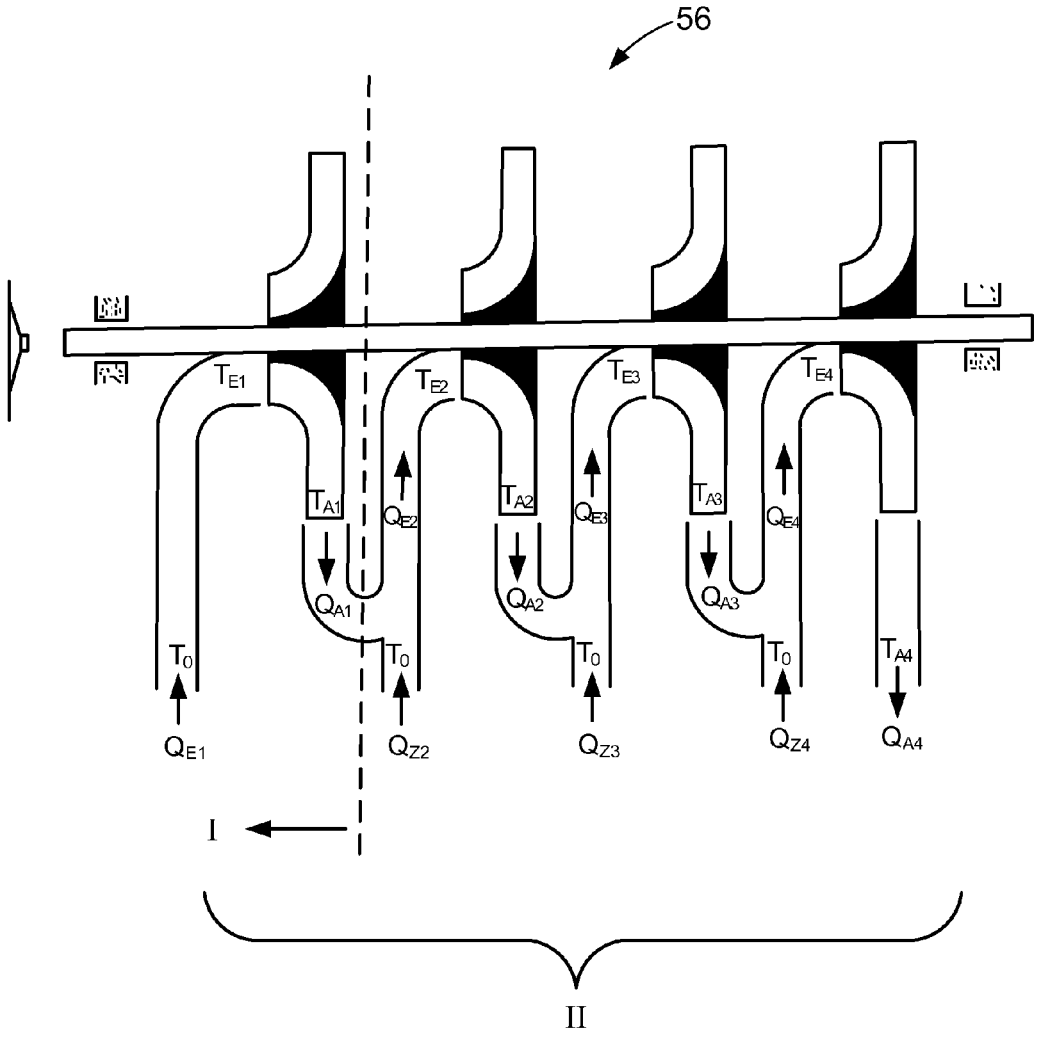
FIG. 2 shows a schematic cross-sectional representation of a blower serving as a pressure booster.

FIG. 2 shows in a schematic cross-sectional representation an exemplary embodiment of the pressure booster 56, which here can be constructed as a single-stage blower I or as a multi-stage blower II.

In this case, said blower can be equipped expediently with connections $Q_{Zi}$ for different vacuum levels.

On the exemplary embodiment in question, as it is shown in particular in FIG. 1, the hood 20 is assigned to the suction roller 16 at least essentially in the region of the suction box 18. Said hood is supplied with hot and as far as possible dry supply air, which flows through the fibrous web 12 covered by the permeable or openly structured belt 22, which can be in particular a mesh, and is discharged again via the suction box 18 as exhaust air. It has been discovered to be an advantage for an efficient drying process if the air temperature is $\geqq 100°$ C. This is important in particular when steam is used for heating the fibrous web 12.

According to the invention, the hood supply air and the suction roller exhaust air are now supplied at least partly in the circuit via the pressure booster 56. In this case the arrangement is selected such that on the one hand the temperature increase caused through compression in the pressure booster 56 is used for promoting the dewatering process while on the other hand the hot exhaust air is re-used.

To compensate air losses, supplementary air can be supplied into the pressure-side socket and/or the suction side socket of the pressure booster 56.

Provision can also be made in particular for a condensation device in order to remove water from the exhaust air.

Similarly, it is possible to use a heating device for the supply air in order to have in particular a control possibility and/or an adjustment possibility for the air temperature.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

List of Reference Numerals

10 Machine
12 Fibrous web
14 Drying apparatus
16 Suction roller
18 Exhaust air chamber, suction box
20 Supply air chamber, hood
22 Permeable structured belt
24 Permeable press belt
26 Dewatering belt
28 Fiber intake nip
30 Forming element, forming roller
32 Headbox
34 Suction element
36 Dewatering belt
38 Pickup or separating element
40 Drying cylinder, Yankee cylinder
42 Press element
44 Press nip
46 Hood
48 Spray tube
50 Uhle box
52 Spray tube
54 Suction side
56 Pressure booster
58 Pressure side
60 Supply air supply line
62 Heating device
64 Water separator
66 Exhaust air discharge line
68 Supply line
70 Another pressure booster
72 Filter
74 Control valve

What is claimed is:

1. An apparatus for drying a web of fibrous material using hot air, said apparatus comprising:

a supply air chamber configured for supplying a supply air with which the web is charged for a drying operation;

an exhaust air chamber configured for being that which an exhaust air from said drying operation passes into;

a pressure booster including a suction side and a pressure side, said exhaust air from said exhaust air chamber being supplied at least partly to said suction side of said pressure booster, at least a part of said supply air being supplied to said supply air chamber coming from said pressure side of said pressure booster; and a hood assigned to a drying cylinder arranged downstream from said supply air chamber and said exhaust air chamber in a travel direction of the web, said supply air supplied to said supply air chamber being taken partly from said hood assigned to said drying cylinder.

2. The apparatus according to claim 1, wherein the apparatus is an impingement drying device.

3. The apparatus according to claim 2, wherein said supply air chamber and said exhaust air chamber are arranged on a same side of the web.

4. The apparatus according to claim 3, wherein said supply air chamber and said exhaust air chamber form a shared space.

5. The apparatus according to claim 1, wherein the apparatus is a through-flow drying device.

6. The apparatus according to claim 5, wherein said supply air chamber and said exhaust air chamber are arranged on opposite sides of the web.

7. The apparatus according to claim 5, wherein a positive pressure in a range from approximately 0 to approximately 0.5 bar exists in said supply air chamber.

8. The apparatus according to claim 5, wherein a positive pressure in a range from approximately 0.002 to approximately 0.3 bar exists in said supply air chamber.

9. The apparatus according to claim 5, wherein a positive pressure ≧0.01 exists in said supply air chamber.

10. The apparatus according to claim 5, wherein a positive pressure ≧0.02 exists in said supply air chamber.

11. The apparatus according to claim 5, wherein a positive pressure ≧0.05 exists in said supply air chamber.

12. The apparatus according to claim 5, wherein a negative pressure in a range from approximately 0 to approximately 0.8 bar exists in said exhaust air chamber.

13. The apparatus according to claim 5, wherein a negative pressure in a range from approximately 0.2 to approximately 0.7 bar exists in said exhaust air chamber.

14. The apparatus according to the claim 5, wherein a negative pressure in a range from approximately 0.4 to approximately 0.7 bar exists in said exhaust air chamber.

15. The apparatus according to claim 1, wherein said pressure booster includes at least one blower.

16. The apparatus according to claim 15, wherein said pressure booster includes at least one multi-stage blower.

17. The apparatus according to claim 15, wherein said pressure booster includes at least one single-stage blower.

18. The apparatus according to claim 15, wherein said pressure booster includes at least one radial blower.

19. The apparatus according to claim 15, wherein said pressure booster includes at least one axial blower.

20. The apparatus according to claim 1, wherein a temperature of one of said supply air and a supply air fraction originating from said pressure booster is ≧100° C.

21. The apparatus according to claim 1, wherein a temperature of one of said supply air and a supply air fraction originating from said pressure booster is ≧150° C.

22. The apparatus according to claim 1, wherein a temperature of one of said supply air and a supply air fraction originating from said pressure booster is ≧200° C.

23. The apparatus according to claim 1, wherein said supply air chamber is supplied with more than 50% of said supply air from said pressure side of said pressure booster.

24. The apparatus according to claim 23, wherein at least essentially 100% of said supply air from said pressure side of said pressure booster is supplied to said supply air chamber.

25. The apparatus according to claim 1, wherein said supply air chamber is supplied with more than 60% of said supply air from said pressure side of said pressure booster.

26. The apparatus according to claim 1, wherein said supply air chamber is supplied with more than 70% of said supply air from said pressure side of said pressure booster.

27. The apparatus according to claim 1, wherein said supply air chamber is supplied with more than 80% of said supply air from said pressure side of said pressure booster.

28. The apparatus according to claim 1, wherein only a part of said supply air from said pressure side of said pressure booster is supplied to said supply air chamber, the rest of said supply air supplied to said supply air chamber being supplied from another hot air process used to produce the web.

29. The apparatus according to claim 1, further including a supply air supply line, connected to said supply air chamber, and a heat exchanger for increasing a temperature of said supply air.

30. The apparatus according to claim 1, further including a supply air supply line, connected to said supply air chamber, and at least one of an adjustable and controllable heating device for increasing a temperature of said supply air.

31. The apparatus according to claim 30, wherein said heating device includes a gas burner.

32. The apparatus according to claim 30, wherein said heating device includes a gas turbine.

33. The apparatus according to claim 1, further including a water separator for removing water from said exhaust air.

34. The apparatus according to claim 33, wherein said water separator is a condensation device.

35. The apparatus according to claim 1, further including a suction roller including a suction box, said exhaust air chamber including said suction box, said supply air chamber including a hood assigned to said suction roller.

36. The apparatus according to claim 35, further including a permeable structured belt, the web being passed together with said permeable structured belt over said suction roller, the web lying between said permeable structured belt and said suction roller, a hot said supply air flowing out from said hood assigned to said suction roller in succession through said permeable structured belt and the web into said suction box of said suction roller.

37. The apparatus according to claim 36, further including a permeable press belt which presses said permeable structured belt and the web against said suction roller, said hot supply air flowing out from said hood assigned to said suction roller in succession through said permeable press belt, said permeable structured belt, and the web into said suction box of said suction roller.

38. The apparatus according to claim 37, further including a dewatering belt which is passed around said suction roller such that said dewatering belt lies between said suction roller and said permeable structured belt and said hot supply air flows through said dewatering belt into said suction box of said suction roller.

39. The apparatus according to claim 35, wherein said drying cylinder together with a press element forms a press nip through which the web is passed directly after said suction roller.

40. The apparatus according to claim 39, wherein said drying cylinder is a Yankee cylinder.

41. The apparatus according to claim 39, wherein said pressure booster includes at least one of a pressure-side socket and a suction-side socket, a hot air taken from said hood assigned to said drying cylinder being supplied as supplementary air to said at least one of said pressure-side socket and said suction-side socket of said pressure booster.

42. The apparatus according to claim 41, further including an exhaust air discharge line connected to said exhaust air chamber and at least one water separator at least one of in said exhaust air discharge line and in at least one of said suction-side socket of said pressure booster and said pressure-side socket of said pressure booster.

43. The apparatus according to claim 42, further including a heating device for increasing a temperature of said supply air, the apparatus being configured for taking said hot air from said hood of said drying cylinder, said water separator being provided, looking in a flow direction of a returned said exhaust air, at least one of upstream from said heating device and upstream from a point at which said hot air taken from said hood of said drying cylinder is supplied.

44. A machine for producing a web of fibrous material with a three-dimensional surface structure, said machine comprising:

a drying apparatus for drying the web using hot air, said drying apparatus including:

a supply air chamber configured for supplying a supply air with which the web is charged for a drying operation;

an exhaust air chamber configured for being that which an exhaust air from said drying operation passes into;

a pressure booster including a suction side and a pressure side, said exhaust air from said exhaust air chamber being supplied at least partly to said suction side of said pressure booster, at least a part of said supply air being supplied to said supply air chamber coming from said pressure side of said pressure booster;

a suction roller including a suction box, said exhaust air chamber including said suction box, said supply air chamber including a hood assigned to said suction roller; and a permeable structured belt, the web being passed together with said permeable structured belt over said suction roller, the web lying between said permeable structured belt and said suction roller, a hot said supply air flowing out from said hood in succession through said permeable structured belt and the web into said suction box of said suction roller.

45. The machine according to claim 44, wherein said drying apparatus includes a permeable press belt, said permeable structured belt and the web being pressed by said permeable press belt against said suction roller, said hot supply air flowing out from said hood in succession through said permeable press belt, said permeable structured belt, and the web into said suction box of said suction roller.

46. The machine according to claim 45, said drying apparatus further including a dewatering belt which is passed around said suction roller such that said dewatering belt lies between said suction roller and said permeable structured belt and said hot supply air flows through said dewatering belt into said suction box of said suction roller.

* * * * *